United States Patent [19]

Miclot

[11] Patent Number: 4,684,158

[45] Date of Patent: Aug. 4, 1987

[54] DEVICE FOR RETAINING A DOOR IN OPEN POSITION

[75] Inventor: André L. Miclot, Maurepas-Village, France

[73] Assignees: Automobiles Peugeot; Automobiles Citroen, both of France

[21] Appl. No.: 806,762

[22] Filed: Dec. 9, 1985

[30] Foreign Application Priority Data

Dec. 26, 1984 [FR] France ..... 84 19818

[51] Int. Cl.[4] ..... E05C 19/02

[52] U.S. Cl. ..... 292/76; 16/354; 49/383; 49/394; 292/341; 292/DIG. 16; 292/DIG. 38

[58] Field of Search ..... 292/271, DIG. 38, 76, 292/341, 265, DIG. 7, DIG. 9, DIG. 15, DIG. 16, DIG. 17, DIG. 61; 16/354; 49/383, 394

[56] References Cited

U.S. PATENT DOCUMENTS

| | | | |
|---|---|---|---|
| 143,585 | 10/1873 | Morris | 292/341 |
| 328,192 | 10/1885 | Coultaus | 292/341 |
| 498,564 | 5/1893 | Morris | 16/354 X |
| 575,683 | 1/1897 | Ansell | 292/341 |
| 1,698,136 | 1/1929 | Lawrence | 16/354 |
| 2,201,594 | 5/1940 | Sitts | 292/76 |
| 2,446,141 | 7/1948 | Parsons | 292/76 X |
| 2,743,127 | 4/1956 | Amy | 292/76 X |
| 2,979,355 | 4/1961 | Brown | 292/76 |
| 2,996,325 | 8/1961 | Chenel | 292/265 |
| 4,064,652 | 12/1977 | Johnston | 292/DIG. 17 X |

FOREIGN PATENT DOCUMENTS

| | | | |
|---|---|---|---|
| 608719 | 11/1960 | Canada | 16/354 |
| 841258 | 5/1970 | Canada | 16/354 |
| 53930 | 10/1890 | Fed. Rep. of Germany | 292/265 |
| 2457413 | 6/1975 | Fed. Rep. of Germany | 16/354 |
| 547949 | 9/1956 | Italy | 49/394 |
| 24171 | of 1894 | United Kingdom | 49/383 |
| 1542245 | 3/1979 | United Kingdom | 16/354 |

*Primary Examiner*—Robert L. Wolfe
*Assistant Examiner*—Lloyd A. Gall
*Attorney, Agent, or Firm*—Steinberg & Raskin

[57] ABSTRACT

This invention relates to a device for retaining a door in open position, comprising two toothed elements of resilient material, positively connected to the door post and the door leaf, respectively, and adapted to mesh with one another during the opening of the door leaf so as to retain the same in open position at a desired opening angle.

14 Claims, 4 Drawing Figures

DEVICE FOR RETAINING A DOOR IN OPEN POSITION

BACKGROUND OF THE INVENTION

The present invention has essentially for a subject matter a device for retaining a door in open position, which can be mounted for example on an automotive vehicle.

It is already known to provide between the leaf and the frame of an automobile door, means for positively maintaining the door leaf in open position at a definite opening angle.

However, the means hitherto known and proposed for this purpose were not always fully and wholly satisfactory, particularly from the point of view of reliability and resistance to wear.

SUMMARY OF THE INVENTION

The present invention has as its purpose to remedy the above drawbacks by providing a particular door retaining device offering all the desired features of reliability and mechanical resistance and, moreover, allowing the door to be moved to any one of various angular opening positions in which it is held firmly.

To this end, the invention is directed to a device for retaining a door in open position, which can be mounted for example on an automotive vehicle, characterized by two toothed elements positively connected to the door frame and the door leaf, respectively, and adapted to mesh with one another so as to retain the door leaf in open position at a desired opening angle.

According to another feature of the device of the invention, the said toothed elements form two surfaces provided with substantially parallel teeth, namely, a first surface secured to the door frame in a plane which is substantially vertical and parallel to the rotation axis of the door leaf, and a second surface secured to the door leaf along substantially an arc of a circle surrounding the said rotation axis represented for example by the vertical rotation axis of hinged joints.

It will also be noted here than the said toothed elements or surfaces are each constituted by a resilient material, e.g. acetal resin for the surface secured to the door frame and polyamide for the surface secured to the door leaf.

According to another feature of the invention, the relative position of the two toothed surfaces secured to the door frame and the door leaf, respectively, is such that the number of teeth engaging one another and, therefore, the retaining force are the more important the greater the angle of opening of the door leaf.

According to a preferred form of embodiment, the toothed surfaces are secured and tensioned on the door frame and the door leaf, respectively, by means of pins or the like snap-fitted into openings provided in the said door frame and leaf.

According to still another feature of the invention, the toothed surface secured to the door leaf is deprived of teeth on its end portions, each of which terminates in a return or backward bend which is substantially at right angles to the other after the said toothed surface is fastened to the door leaf.

It should also be observed that, according to the present invention, the fastening of at least the toothed surface on the door leaf is adjustable to allow preadjusting its tensioning or stressing.

Furthermore, it will be pointed out here that one of the said ends of the toothed surface fastened to the door leaf is provided with at least one stop co-operating with the door frame to determine a maximum opening angle of the door leaf.

BRIEF DESCRIPTION OF THE DRAWINGS

But other features and advantages of the invention will appear more clearly as the following detailed description proceeds with reference to the appended drawings given solely by way of example and wherein.

DESCRIPTION OF THE PREFERRED EMBODIMENT

Figure 1:
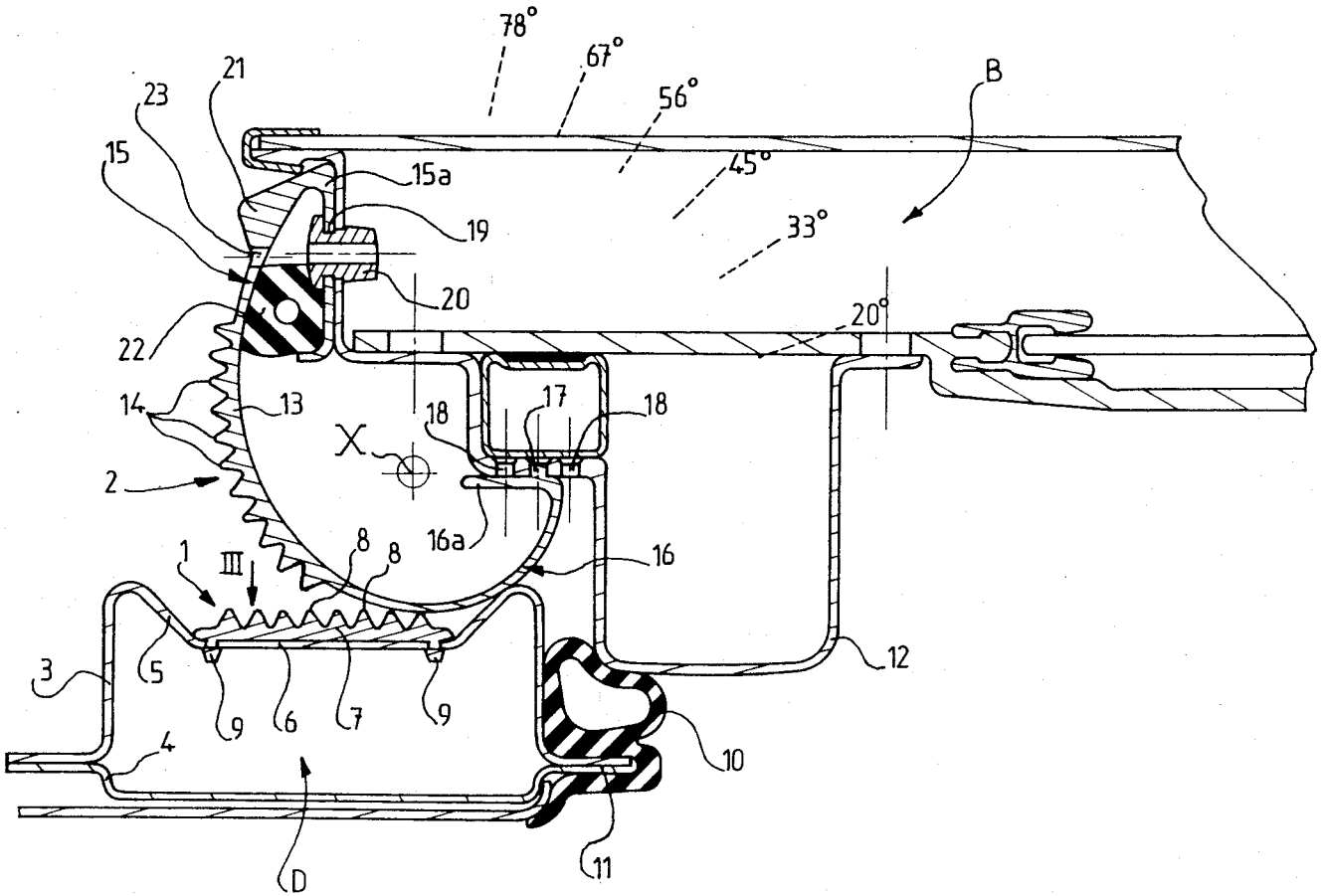
FIG. 1 is a partial and cross-sectional view of a door frame and a door leaf in the closed position, the said door frame and leaf being provided with the device of the invention.

According to one example of embodiment and referring particularly to FIG. 1, it is seen that a device according to the invention includes essentially two toothed elements 1 and 2 secured to the frame D and the leaf B, respectively, of a vehicle door, which toothed elements are adapted to mesh with one another when the door leaf is opened, so as to retain the latter in open position at a desired opening angle.

In the example of embodiment illustrated, the door frame or post D is constituted by an assembly of two stampings 3 and 4 defining a tubular pillar having a substantially rectangular horizontal section. The stamping 3 located on the outside of the vehicle has a recessed portion 5 with a flat bottom wall 6 to which is fastened the toothed element 1 which is in the form of a grate or surface 7 provided with a plurality of teeth 8 and made from acetal resin.

Figure 3:
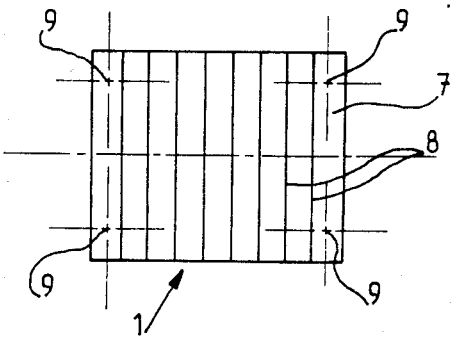
FIGS. 3 and 4 are front views, in the direction of arrows III and IV, of FIGS. 1 and 2, of the toothed elements secured on the door frame and the door leaf, respectively.

The toothed surface 7 is fastened to the flat bottom wall or face 6 of the door post D by four pins or the like 9 (see FIGS. 1 and 3) snap-fitted into openings provided in the said flat bottom wall 6. Thus, the resilient surface 7 with its parallel teeth 8 is secured to the door frame D in a vertical plane which is parallel to the axis of rotation X of the door leaf B.

There is shown at 10 a hollow gasket adhering to the door frame D and located on the door frame side confronting the door leaf B, the said gasket 10 surrounding the junction 11 of the two stampings 3 and 4 constituting the door frame D. The gasket 10 is intended to cave in when engaged by a rabbet bend portion 12 of the door leaf B when the latter is in closed position.

Figure 2:
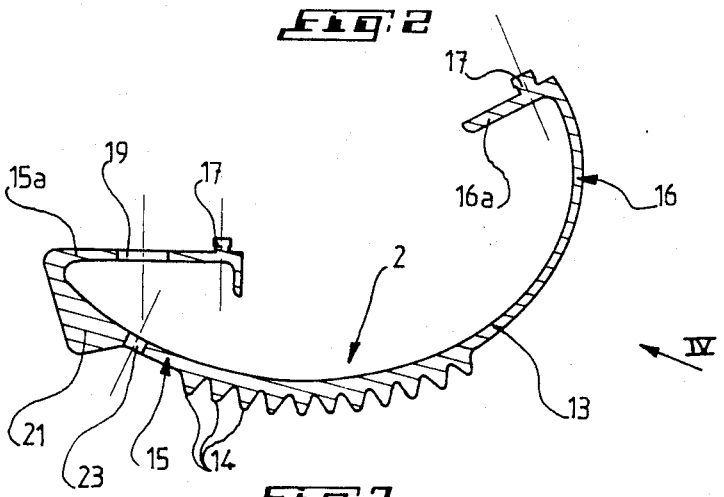
FIG. 2 is a cross-sectional view of the toothed element for the door leaf, showing the said element in its free or released state.
Figure 4:
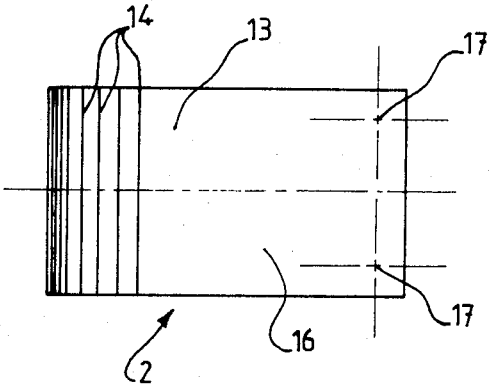

As seen clearly in FIGS. 1, 2 and 4, the toothed element 2 secured to the door leaf is constituted by a grate or surface 13 provided with a plurality of parallel teeth 14 and having, in the free or released state (FIG. 2), the shape of substantially an arc of a circle of about 130°. The surface 13 is preferably of polyamide and is fastened to the door leaf B in such a manner as to surround the rotation axis X, so that the teeth 14 are substantially parallel to the teeth 8 of the toothed surface 7 and can mesh with the teeth 8 when the door leaf B is rotated.

More precisely, the toothed surface 13 has two end portions 15 and 16 deprived of teeth and each terminating in a return or backward bend 15*a*, 16*a*, respectively. The bends 15*a*, 16*a* are each provided with pins or the like 17 adapted to be snap-fitted into holes provided in the rabbet bend portion of the door leaf B to thus secure the toothed surface 13. As seen in FIG. 1, the two return or backward bends 15*a* and 16*a* are substantially at right angles to one another after the toothed surface 13 is fastened to the door leaf B, the said fastening having a course the effect of tensioning the said surface as is obvious from FIGS. 1 and 2.

As appears from FIG. 1, several holes 18 are provided in the rabbet bend portion 12 to receive the pins 17 and to allow the tensioning of the toothed surface 13 to be previously adjusted.

The backward bend 15*a* of the surface 13 is provided with a hole 19 into which can be inserted an appropriate means 20 for additionally securing the toothed surface 13 to the rabbet bend portion of the door. At 21 is shown a stop or shoulder protruding from the untoothed end portion 15 of the surface 13 and intended to so co-operate with the door frame D as to determine the maximum angle of opening of the door leaf B.

As appears from FIG. 1, a block 22 of rubber or of synthetic material is compressed between the bend 15*a* and the arcuate portion of the toothed surface 13 so as to subject the latter to stress.

In proximity to the stop 21 is provided, in the untoothed portion 15 of the surface 13, a hole 23 for the insertion of a tool for snapping in the means for fastening the bend 15*a* of the grate or toothed surface 13.

As stated in the foregoing, the mounting of the toothed surface 13 has a stressing effect on the latter since, in the initial state, the bends 15*a*, 16*a* of the said surface form an angle of about 140° with respect to one another, as seen in FIG. 2, whereas after the mounting, the said bends are at right angles to one another as appears from FIG. 1. Such a stressing effect on the surface 13 tends to cause the teeth 14 to penetrate into the toothing 8 of the surface 7 positively connected to the door post D, and in order to change from one angle of opening of the door leaf B to another, the toothed surface must be deformed, so that an effort must be exerted both in the opening direction and the closing direction, which means that the door leaf will be correctly maintained at the selected opening angle.

In this respect, it can be seen in FIG. 1 that if the door leaf B is rotated about its hinges or rotation axis X in the counter-clockwise direction, the result is:

at an angle of 20°, the engagement of one tooth,
at an angle of 33°, the engagement of two teeth,
at an angle of 45°, the engagement of four teeth,
at an angle of 56°, the engagement of six teeth,
at an angle of 67°, the engagement of seven teeth, and
at an angle of 78°, the engagement of seven teeth, in which position the toothed surface 13 is stopped.

It is therefore understood that the number of teeth 14 and 8 meshing with one another and, therefore, the retaining force increase as the angle of opening of the door leaf B becomes greater.

There is therefore obtained, according to the invention, a door retaining device which is remarkably simple and reliable, inexpensive, requires no lubrication, produces neither noise nor creaking, resolves the corrosion problems and requires no additional members for ensuring fluid-tightness.

Of course, the invention is by no means limited to the form of embodiment described and illustrated which has been given by way of example only.

On the contrary, the invention includes all technical equivalents to the means described as well as their combinations if the latter are carried out according to its gist.

What is claimed is:

1. An assembly, comprising:
a door or leaf member (B),
a post member (D), and
a device for retaining said leaf member in open position,
said post member (D) comprising a flat wall (6), and
said leaf member (B) pivotally mounted about an axis of rotation (X) thereof,
wherein said device comprises
a first toothed surface (7) made of a resilient material and fastened to said flat wall (6) of said post member (D), said first toothed surface arranged in a plane which is substantially vertical and parallel to said axis of rotation (X), and
a second toothed surface (13) made of a resilient material and fastened to said leaf member (B) along substantially an arc of a circle surrounding said axis of rotation (X) and positioned to mesh with said first toothed surface (7) as said leaf member (B) is pivoted about said axis of rotation (X),
said first and second toothed surfaces having a relative position and extent such that the number of teeth (14) of said second toothed surface (13) meshing with the teeth (8) of said first toothed surface (7) increases as an angle of opening of said leaf member (B) becomes greater so as to provide a corresponding increase of door leaf retaining force.

2. The assembly of claim 1, wherein said second toothed surface (13) comprises means for adjustably tensioning or stressing the same according to the arc of the circle.

3. The assembly of claim 1, wherein said second toothed surface (13) comprises end portions (15, 16) which are devoid of teeth and each end portion includes a return or backward bend (15*a*, 16*a*) said bends being substantially at right angles with respect to one another when said toothed surface is fastened on said leaf member (B).

4. The assembly of claim 3, wherein said second toothed surface comprises means for adjustably tensioning or stressing said second toothed surface (13) according to the arc of the circle, comprising several holes (18) provided on said leaf member (B) to allow adjustable fastening of at least one of said bends (16*a*) to said leaf member.

5. The assembly of claim 3, wherein said bends (15*a*, 16*a*) form an angle of about 140° in a free or released state of said second toothed surface (13).

6. The assembly of claim 3, and further comprising at least one shoulder (21) providing on one of said end portions of said second toothed surface (13) for cooperating with said post member (D) to define a maximum angle of opening of said leaf member (B).

7. The assembly of claim 3, wherein said second toothed surface comprises means for adjustably tensioning or stressing the same according to the arc of the circle, comprising a block member (22) of resilient material compressed between one of said bends (15*a*) and an arcuate portion of said second toothed surface.

8. The assembly of claim 1, wherein said resilient material of said first toothed surface (7) is made of an acetal resin, and the resilient material of said second toothed surface (13) is made of a polyamide.

9. The assembly of claim 9, wherein said post member (D) is formed of two stampings (3,4) assembled to define a tubular pillar having a substantially rectangular horizontal section, with one of said stampings (3) facing said leaf member (B) comprising a recessed portion (5) forming said flat wall (6) of said post member (D).

10. The assembly of claim 9, additionally comprising means (9) for snap-fitting said first toothed surface (7) onto said flat wall (6).

11. The assembly of claim 9, additionally comprising a hollow gasket (10) surrounding a junction (11) of said two stampings (3,4) forming said post member (D).

12. The assembly of claim 11, wherein said leaf member (B) additionally comprises a rabbet bend portion (12) mounted thereon to contact and cave-in said gasket (10) when said leaf member (B) is in closed position.

13. The assembly of claim 12, additionally comprising means for securing said second toothed surface (13) to said rabbet bend portion (12) of said leaf member (B).

14. The assembly of claim 20, wherein said second toothed surface (13) comprises an end portion (15) devoid of teeth and having a return or backward bend (15*a*), and a securing means comprises a hole (19) in said bend (15*a*) for insertion of an element (20) to secure said second toothed surface (13) to said rabbet bend portion (12).

* * * * *